US008606159B2

(12) United States Patent
Cao et al.

(10) Patent No.: US 8,606,159 B2
(45) Date of Patent: Dec. 10, 2013

(54) FUSER FOR AN ELECTROPHOTOGRAPHIC IMAGING DEVICE TO MAINTAIN A HIGH FUSER BELT TEMPERATURE

(75) Inventors: Jichang Cao, Lexington, KY (US); Michael David Maul, Lexington, KY (US); Jerry Wayne Smith, Irvine, KY (US); Scott Shiaoshin Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 104 days.

(21) Appl. No.: 12/886,241

(22) Filed: Sep. 20, 2010

(65) Prior Publication Data

US 2012/0070207 A1 Mar. 22, 2012

(51) Int. Cl.
*G03G 15/20* (2006.01)

(52) U.S. Cl.
USPC ..... 399/328

(58) Field of Classification Search
USPC ..... 399/329
See application file for complete search history.

(56) References Cited

U.S. PATENT DOCUMENTS

| | | | |
|---|---|---|---|
| 5,602,635 | A | 2/1997 | Domoto et al. |
| 5,774,763 | A | 6/1998 | Muramatsu |
| 5,974,294 | A | 10/1999 | Tange |
| 7,076,198 | B2 | 7/2006 | Kim et al. |
| 7,235,761 | B1 | 6/2007 | Maul et al. |
| 7,466,951 | B2 | 12/2008 | Gilmore |
| 2003/0063931 | A1 | 4/2003 | Sanpei et al. |
| 2006/0067752 | A1 | 3/2006 | Cao et al. |
| 2006/0198671 | A1 | 9/2006 | Kawahata |
| 2008/0175633 | A1 | 7/2008 | Shinshi |
| 2008/0232871 | A1 | 9/2008 | Jung et al. |
| 2009/0208264 | A1* | 8/2009 | Fujiwara et al. ..... 399/329 |
| 2010/0167065 | A1 | 7/2010 | Cao et al. |
| 2010/0303524 | A1 | 12/2010 | Cao et al. |

FOREIGN PATENT DOCUMENTS

| | | | |
|---|---|---|---|
| JP | 52102736 | A | 8/1977 |
| JP | 06035354 | A * | 2/1994 |
| JP | 406035354 | | 2/1994 |
| JP | 07287461 | A * | 10/1995 |
| JP | 11052768 | A | 2/1999 |
| JP | 2001125409 | A | 5/2001 |

OTHER PUBLICATIONS

U.S. Appl. No. 12/473,967 to Cao et al., filed May 28, 2009.*
Notice of Allowability for U.S. Appl. No. 12/473,967, U.S. Patent and Trademark Office, Dec. 14, 2012.
Patent Coorperation Treaty (PCT), International Search Report for PCT Application PCT/US2011/061492, Mar. 19, 2012.
Office Action for U.S. Appl. No. 12/473,967, Apr. 3, 2013.

* cited by examiner

*Primary Examiner* — Quana M Grainger
(74) *Attorney, Agent, or Firm* — William F. Esser

(57) ABSTRACT

A fuser for an electrophotographic imaging device according to one embodiment includes a stationary pressure member having an elongated body with an outer surface. The pressure member is substantially transparent and/or substantially translucent and permits the passage of radiant heat therethrough. An endless fusing belt having a flexible tubular configuration is rotatably positioned about the pressure member. The pressure member is positioned around a heating lamp for transmitting radiant heat through the pressure member to an inner surface of the fusing belt. A backup roll opposes the fusing belt. The pressure member is configured to apply pressure contact to the fusing belt against the backup roll to form a fuser nip between the backup roll and a segment of the fusing belt.

26 Claims, 11 Drawing Sheets

FUSER FOR AN ELECTROPHOTOGRAPHIC IMAGING DEVICE TO MAINTAIN A HIGH FUSER BELT TEMPERATURE

CROSS REFERENCES TO RELATED APPLICATIONS

None.

BACKGROUND

1. Technical Field

The present application relates generally to an electrophotographic imaging device and more particularly to a fuser for an electrophotographic imaging device.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image and thereafter the toner image is transferred to the media intended to receive the image. The toner is fixed to the media by a combination of heat and pressure applied by a fuser.

The fuser may include a belt fuser that includes a fusing belt and an opposing backup member, such as a backup roll. The belt and the backup member form a nip therebetween. The media with the toner image is moved through the nip to fuse the toner to the media. Belt fusers allow for "instant-on" fusing where the fuser has a relatively short warm up time thereby reducing electricity consumption. Fusing speed is a function of the width of the fuser nip and the belt surface temperature, among other things. A fuser with a relatively wide nip is able to fuse toner to media moving at higher speeds through the nip than a comparable fuser with a relatively narrow nip. Further, a fuser with a higher belt surface temperature is able to fuse toner to the media faster than a fuser with a lower belt surface temperature. Higher fusing speeds in turn lead to higher print speeds.

Conventional ceramic and inductive heating belt fusers utilize a stationary pressure member to form a flat nip with a backup member. Ceramic and inductive heating belt fusers typically include high temperature grease disposed between the contact surface of the belt and the pressure member to reduce the friction therebetween. FIG. 1 shows a prior art belt fuser with a ceramic heater. A stationary pressure member 7, a ceramic heater 5 and a heater housing (not shown) are positioned inside an endless fusing belt 3. The stationary pressure member 7 forces the endless fusing belt 3 to contact a pressure roll 9 to form a fuser nip 2. FIG. 2 shows a prior art belt fuser with an inductive heater. A stationary pressure member 15, an inductive heater 13 and a heater housing (not shown) are positioned inside an endless fusing belt 11. The stationary pressure member 15 forces the endless fusing belt 11 to contact a pressure roll 19 to form a fuser nip 4. The fuser nips of the ceramic and inductive heating belt fusers can generally be expanded to form a wider nip but unless the set point of the heat source is increased, widening the nip does not significantly raise the surface temperature of the belt, which is necessary for high speed fusing, because the belt is only heated within a predefined region. However, in some instances, increasing the set point of the heat source can cause degradation of grease between the contact surface of the belt and the stationary pressure member. Grease degradation drastically increases the likelihood of belt stalls in the fuser as a result of increased friction wear. Further, the ceramic heater is coupled to the stationary pressure member thereby requiring a flat nip.

Lamp heating belt fusers utilize a rotating quartz tube pressure member to form a rounded nip shape against a backup roll. FIG. 3 shows a known lamp heating belt fuser. A rotating quartz tube pressure member 20 and a lamp 22 are positioned inside an endless fusing belt 24. The rotating pressure member 20 forces the fusing belt 24 to contact a pressure roll 26 to form a fuser nip 28. Lamp heating belt fusers are capable of achieving higher belt temperatures than ceramic or inductive heating belt fusers because the rotating quartz tube pressure member allows radiant heat emitted from the lamp to be delivered to substantially the entire inner surface of the belt. However, the rounded nip makes it difficult to increase the width of the fuser nip because it requires increasing the diameter of the quartz tube and the fusing belt. This, in turn, leads to more thermal mass in the system and increases the warm-up time of the fuser. Further, the rotating quartz tube pressure member requires a rounded nip due to its circular cross-section.

Accordingly, it will be appreciated that an efficient belt fuser with enhanced fusing performance is desired.

SUMMARY

A fuser for an electrophotographic imaging device according to one embodiment includes a stationary pressure member having an elongated body that includes an outer surface. The pressure member is substantially transparent and/or substantially translucent and permits the passage of radiant heat therethrough. An endless fusing belt having a flexible tubular configuration is rotatably positioned about the pressure member. The pressure member is positioned around a heating lamp for transmitting radiant heat through the pressure member to an inner surface of the fusing belt. A backup roll opposes the fusing belt. The pressure member is configured to apply pressure contact to the fusing belt against the backup roll to form a fuser nip between the backup roll and a segment of the fusing belt. In some embodiments, the pressure member is composed of quartz and/or glass. In some embodiments, the outer surface of the pressure member has a non-circular cross section.

Embodiments include those wherein the outer surface of the pressure member includes a substantially planar length-wise segment. In some embodiments, the fuser nip is formed along the substantially planar segment. Further embodiments include those wherein the outer surface of the pressure member includes a plurality of additional substantially planar length-wise segments. In some embodiments, the planar segment and the additional planar segments have substantially the same dimensions.

Additional embodiments include those wherein the outer surface of the pressure member includes a length-wise concave segment. In some embodiments, the fuser nip is formed along the concave segment. Further embodiments include those wherein the outer surface of the pressure member includes a plurality of additional length-wise concave segments. In some embodiments, the concave segment and the additional concave segments have substantially the same dimensions. In some embodiments, the backup roll is matably aligned with the concave segment.

Embodiments include those wherein the elongated body of the pressure member includes a length-wise cutout therein to permit the heating lamp to transmit radiant heat directly to a portion of an inner surface of the fusing belt without passing through the pressure member. In some embodiments, the outer surface of the pressure member also includes a substantially planar length-wise segment and/or a length-wise concave segment.

Further embodiments include those wherein the outer surface of the pressure member includes a length-wise convex segment formed between two substantially planar length-wise segments.

BRIEF DESCRIPTION OF THE DRAWINGS

The above-mentioned and other features and advantages of the various embodiments, and the manner of attaining them, will become more apparent and will be better understood by reference to the accompanying drawings, wherein.

DETAILED DESCRIPTION

Figure 1:
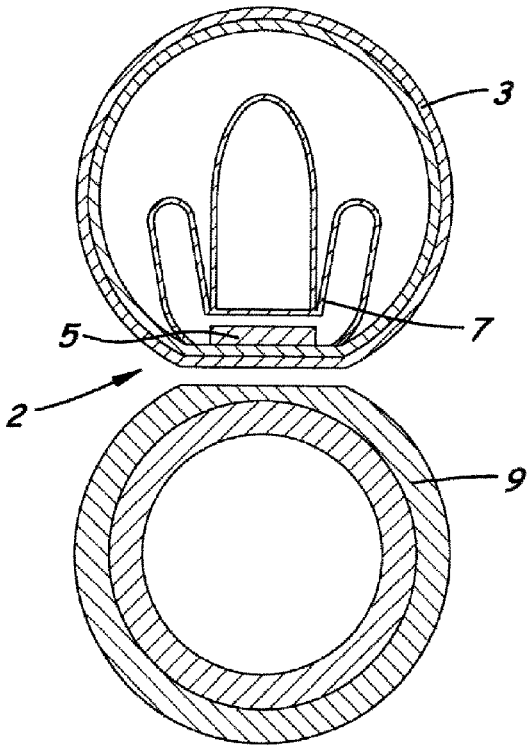
FIG. 1 PRIOR ART
FIG. 1 is a cross sectional view of a prior art ceramic heating belt fuser.
Figure 2:
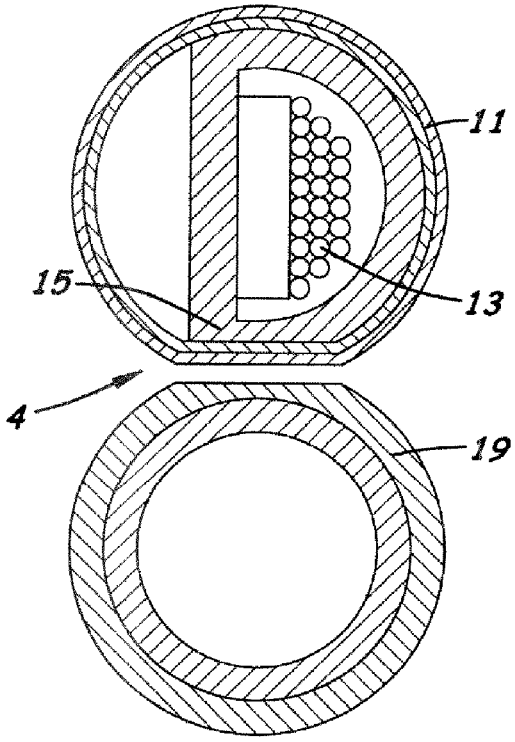
FIG. 2 PRIOR ART
FIG. 2 is a cross sectional view of a prior art inductive heating belt fuser.
Figure 3:
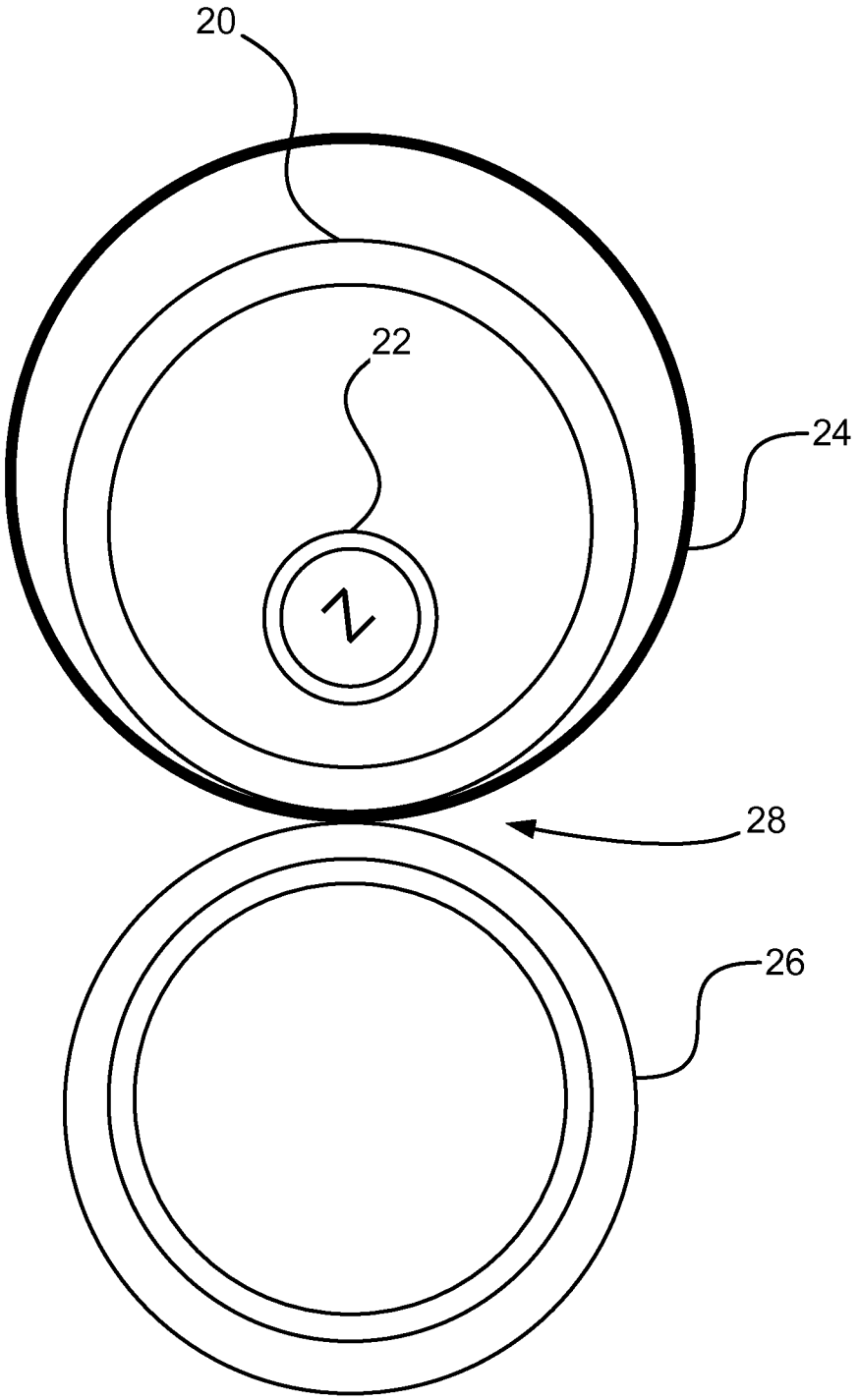
FIG. 3 PRIOR ART
FIG. 3 is a cross sectional view of a prior art lamp heating belt fuser having a rotating pressure member.
Figure 4:
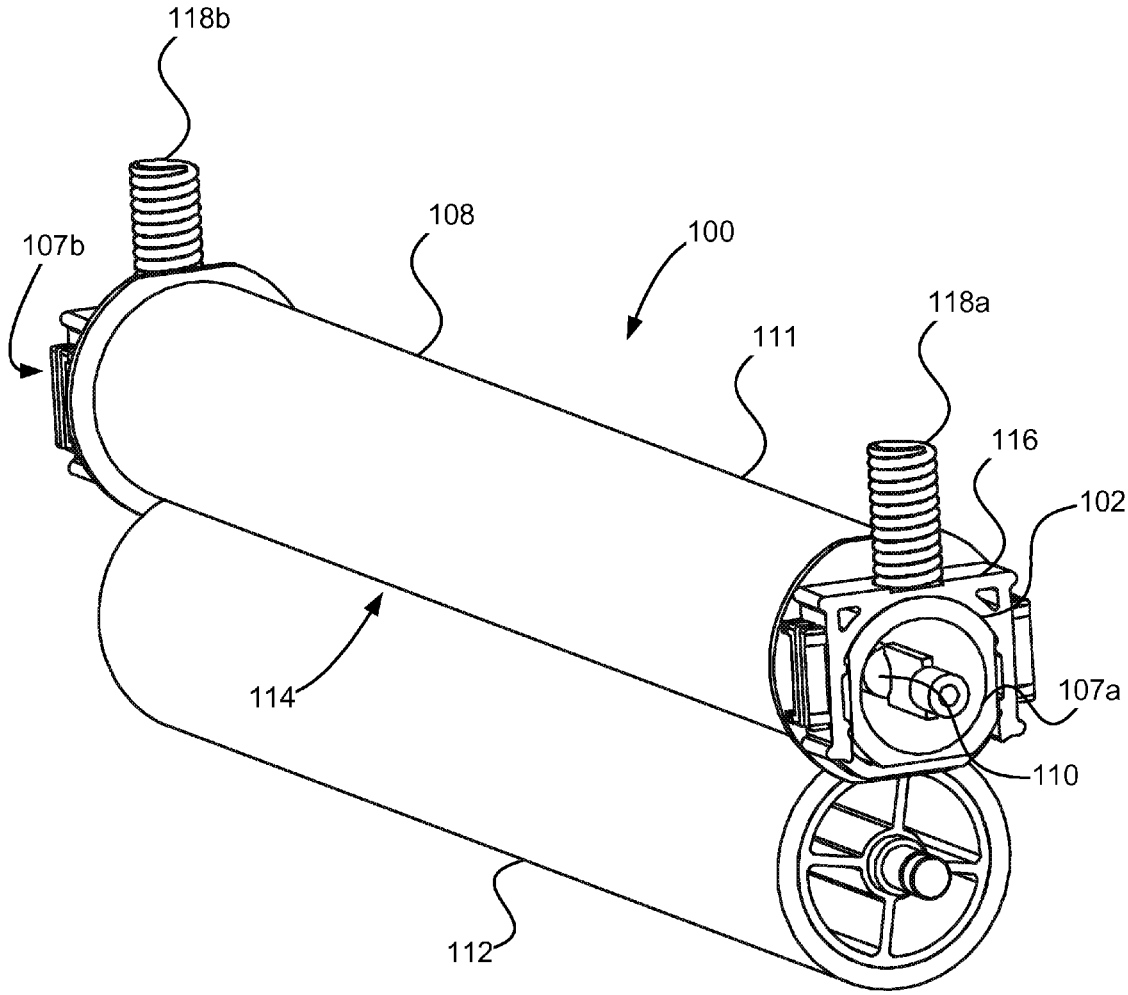
FIG. 4 is a perspective view of a fuser assembly according to one embodiment.
Figure 5:
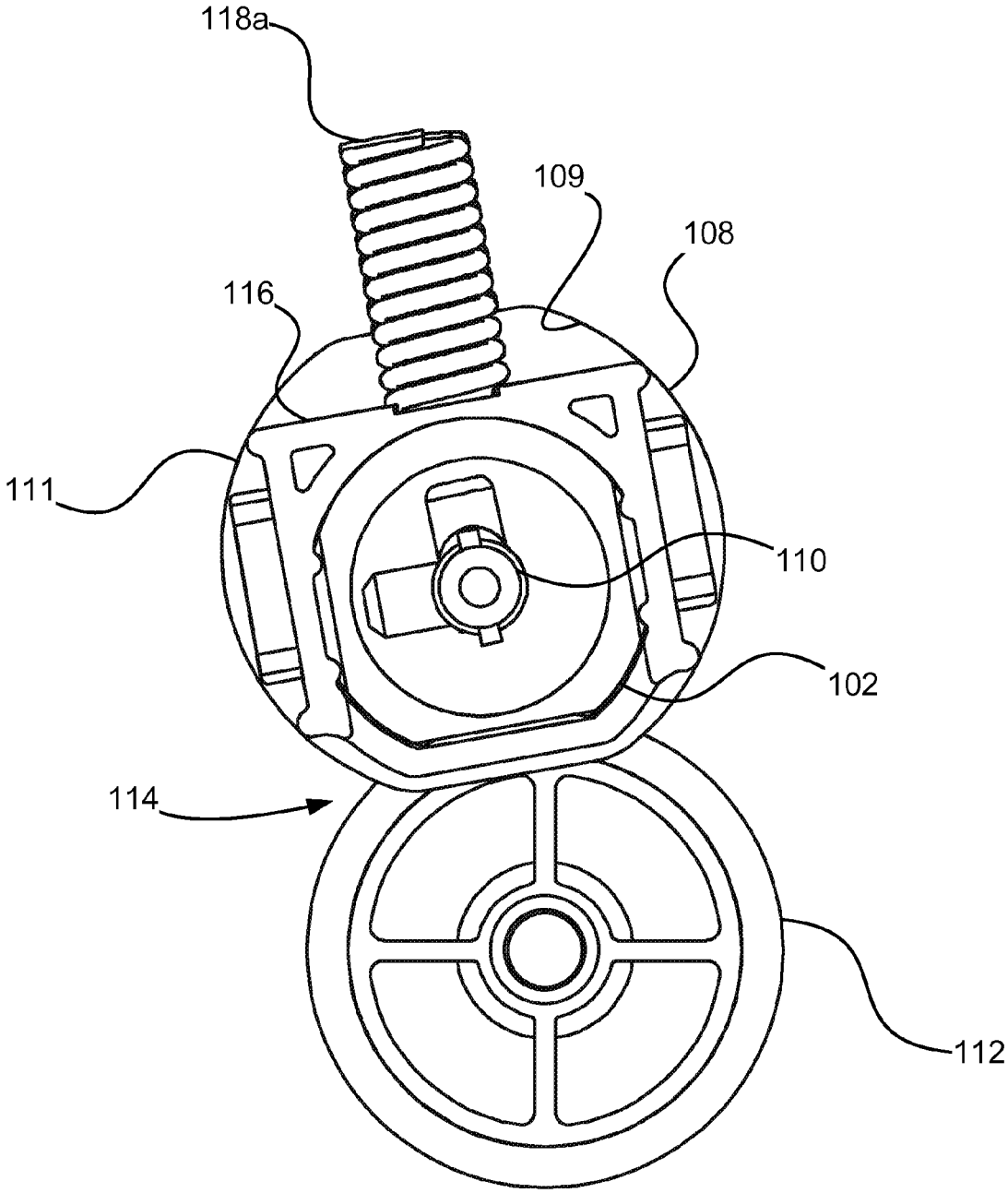
FIG. 5 is a side elevation view along the longitudinal axis of the fuser shown in FIG. 4.
Figure 6:
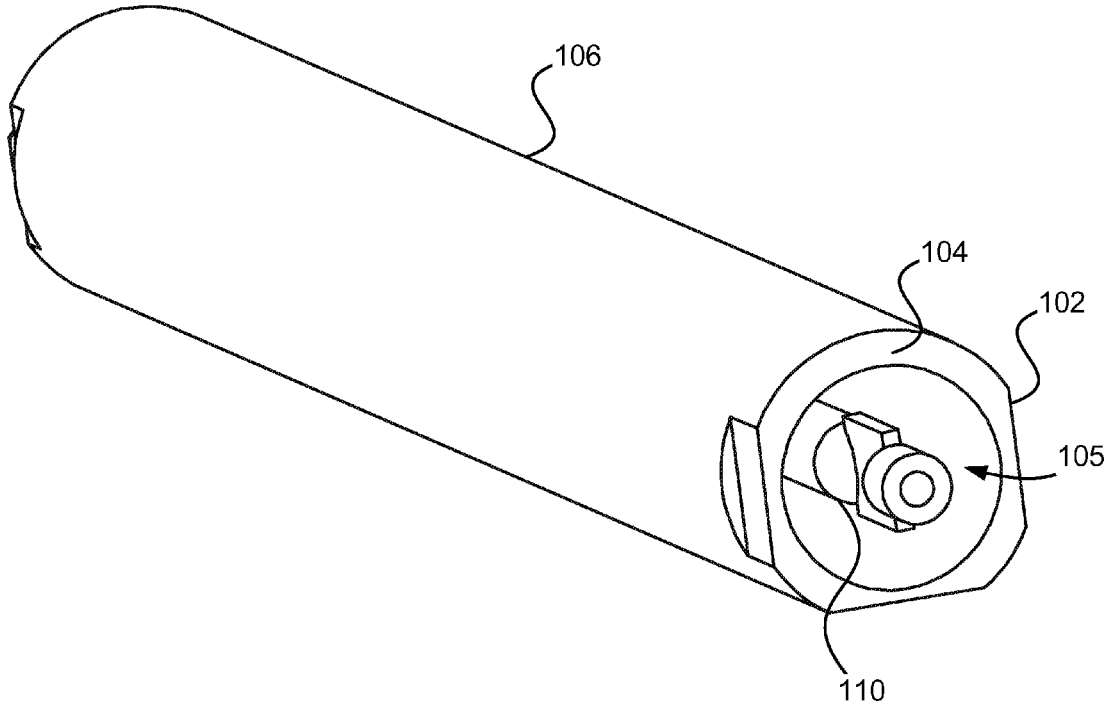
FIG. 6 is a perspective view of a pressure member having a heating lamp therein according to one embodiment.
Figure 7:
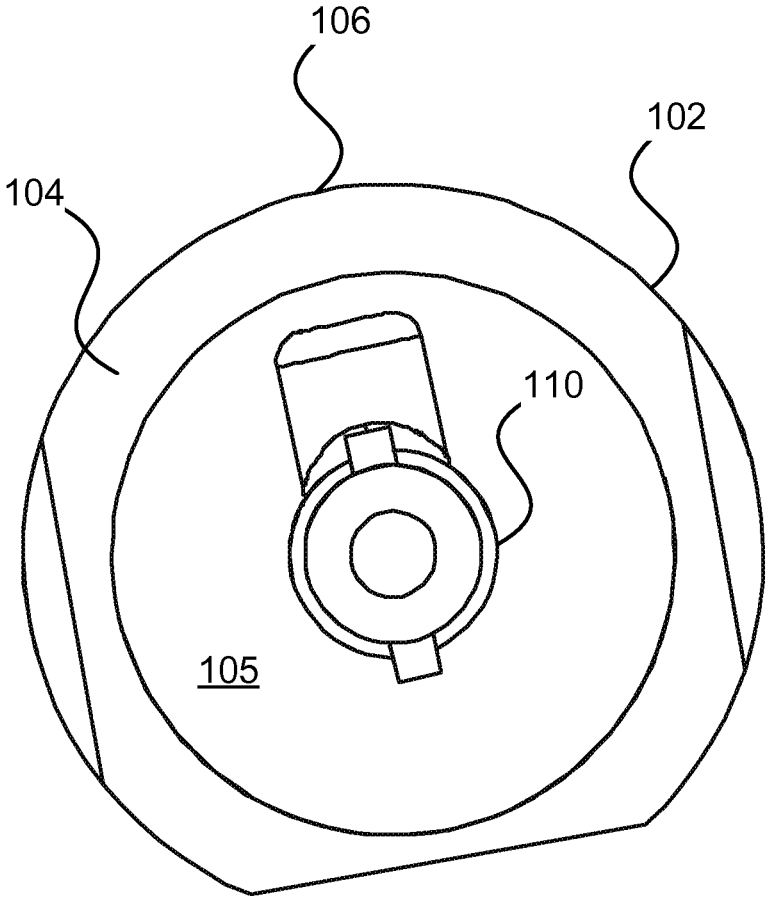
FIG. 7 is a side elevation view along the longitudinal axis of the pressure member shown in FIG. 6.

The following description and drawings illustrate embodiments sufficiently to enable those skilled in the art to practice it. It is to be understood that the subject matter of this application is not limited to the details of construction and the arrangement of components set forth in the following description or illustrated in the drawings. The subject matter is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present application as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

With reference to FIGS. 4-7, a fuser 100 for an electrophotographic printer is shown. The fuser 100 includes a stationary pressure member 102 having an elongated body 104 that includes an outer surface 106 and a pair of opposite ends 107*a*, 107*b*. The pressure member 102 is substantially transparent and/or substantially translucent and permits the passage of radiant heat therethrough. The pressure member 102 may be composed of quartz, glass or any other substantially transparent or substantially translucent material. The pressure member 102 includes a length-wise channel 105 therein configured to receive and house a heat source. The body 104 of the pressure member 102 may be solid or hollow. An endless fusing belt 108 is rotatably positioned about the pressure member 102 and spaced outwardly therefrom. The fusing belt 108 has a flexible tubular configuration. The fusing belt 108 may be, for example, a steel belt, a polyimide belt, a steel belt coated with silicone rubber on its outer surface 111 or a polyimide belt coated with silicone rubber on its outer surface 111. The outer surface 111 of the fusing belt 108 may include a toner release layer such as a layer of fluoropolymer coating or sleeve. In some embodiments, a high temperature grease is disposed between the fusing belt 108 and the pressure member 102 to reduce friction between the two. A heating lamp 110 is positioned within the channel 105 of the pressure member 102. The heating lamp 110 is configured to transmit radiant heat through the pressure member 102 to an inner surface 109 of the rotatable fusing belt 108 to heat the fusing belt 108. In some embodiments, the heating lamp 110 is configured to heat the entire inner surface 109 of the fusing belt 108. The pressure member 102 is seated upon a support assembly 116 that holds the pressure member 102 and fusing belt 108 assembly in place. Lamp brackets (not shown) support the heating lamp 110 on each end and provide electrical contact to the heating lamp 110.

A backup roll 112 opposes the fusing belt 108 forming a fuser nip 114 between the backup roll 112 and a segment of the fusing belt 108. The pressure member 102 is configured to apply pressure contact to the fusing belt 108 against the backup roll 112 to form the fuser nip 114. In some embodiments, the pressure member 102 is biased against the backup roll 112 by a pair of springs 118*a*, 118*b* mounted on the support assembly 116 on the ends 107*a*, 107*b* of the pressure member 102. Backup roll 112 may include one layer or more than one layer. For example, backup roll 112 may include an inner metal core and an outer layer, such as a silicone rubber layer. In some embodiments, the backup roll 112 drives the fusing belt 108 by friction contact. Alternatives include those wherein the fusing belt 108 is independently driven by a motor (not shown).

The pressure member 102 may have greater than about 70%, and more particularly greater than about 90%, transparency to the emission spectrum of the heating lamp 110 so that most of the radiant heat from heating lamp 110 can pass through the pressure member 102 to heat the fusing belt 108. Embodiments include those wherein the thickness of pressure member 102 is between about 1 mm and about 8 mm, and more particularly between about 2 mm and about 4 mm, in order to maintain a relatively low thermal mass. The outer perimeter of the pressure member 102 is smaller than the circumference of the inner surface 109 of the fusing belt 108 in order to allow the fusing belt 108 to rotatably pass about the pressure member 102. In some embodiments, the difference between the outer perimeter of the pressure member 102 and the circumference of the inner surface 109 of the fusing belt 108 is such that the fusing belt 108 physically contacts the pressure member 102 only in the region of the fuser nip 114. In such embodiments, the contact between the fusing belt 108 and the pressure member 102 is minimized in order to reduce conductive heat transfer from the fusing belt 108 to the pressure member 102. As a result, the majority of the heat transferred to the fusing belt 108 by the heating lamp 110 is retained by the fusing belt 108 until it is transferred to the media. This allows the fusing belt 108 to warm up quickly and to maintain a high belt surface temperature. In these embodiments, a relatively small gap exists between the fusing belt 108 and the pressure member 102 in regions outside the fuser nip 114 to minimize the slack in the belt 108.

The use of a stationary pressure member 102 allows a variety of pressure member shapes to be used depending on the desired size and shape of the fuser nip 114. The shape of the fuser nip 114 can be optimized to minimize the stress on the fusing belt 108 and to remove reverse bends in the fusing belt 108 to reduce belt cracking. The shape of the outer surface 106 of the pressure member 102 can be configured to allow for a flat, concave or convex fuser nip 114, as desired. Where the fuser nip 114 is concave or convex, various degrees of curvature of the outer surface 106 of the pressure member 102 may be utilized, as desired. Accordingly, the outer surface 106 of the pressure member 102 may have a circular or non-circular cross-section.

Figure 8:
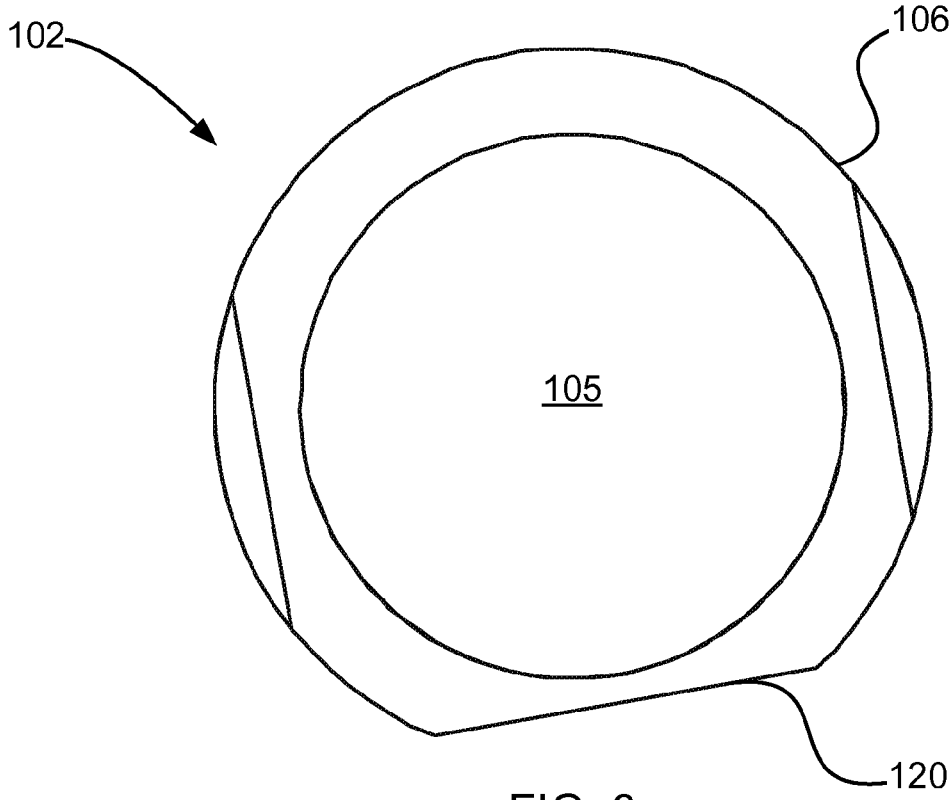
FIG. 8 is a side elevation view of a "D-shaped" pressure member according to one embodiment.
Figure 9:
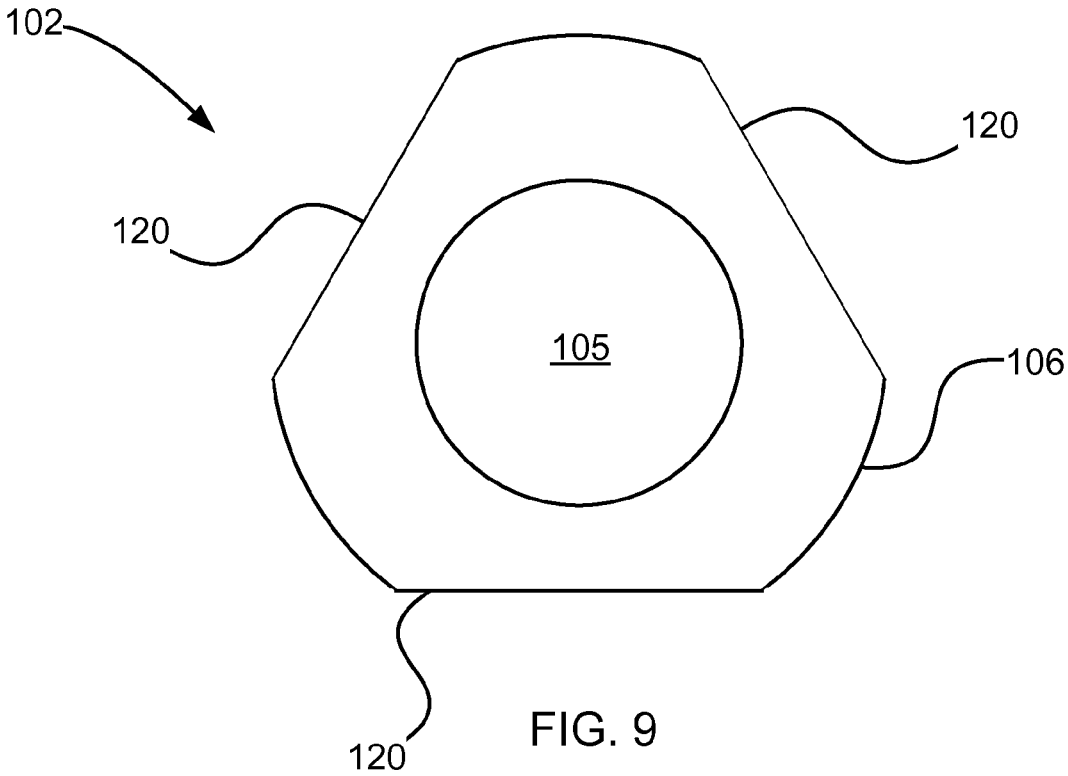
FIG. 9 is a cross sectional view of a pressure member having a plurality of substantially planar length-wise segments according to one embodiment.

For example, embodiments include those wherein the pressure member 102 is generally "D-shaped" in cross-section as shown in FIG. 8. The outer surface 106 of the pressure member 102 illustrated includes a substantially planar length-wise segment 120. In the embodiment illustrated in FIG. 8, the remainder of the pressure member 102 has a circular cross-section. The pressure member 102 is oriented such that the substantially planar segment 120 applies pressure contact to the fusing belt 108 against the backup roll 112 to form a substantially flat fuser nip 114. As shown in FIG. 9, in some embodiments, the outer surface 106 of the pressure member 102 includes at least one and in some cases a plurality of additional substantially planar length-wise segments 120 that extend along the length of the outer surface 106. Where multiple substantially planar segments 120 are employed, each segment 120 may have substantially the same width, as illustrated in the embodiment shown. Alternatively, each segment 120 may have a different width. The inclusion of multiple substantially planar length-wise segments 120 allows selection of the segment 120 that will form the fuser nip 114.

Figure 10:
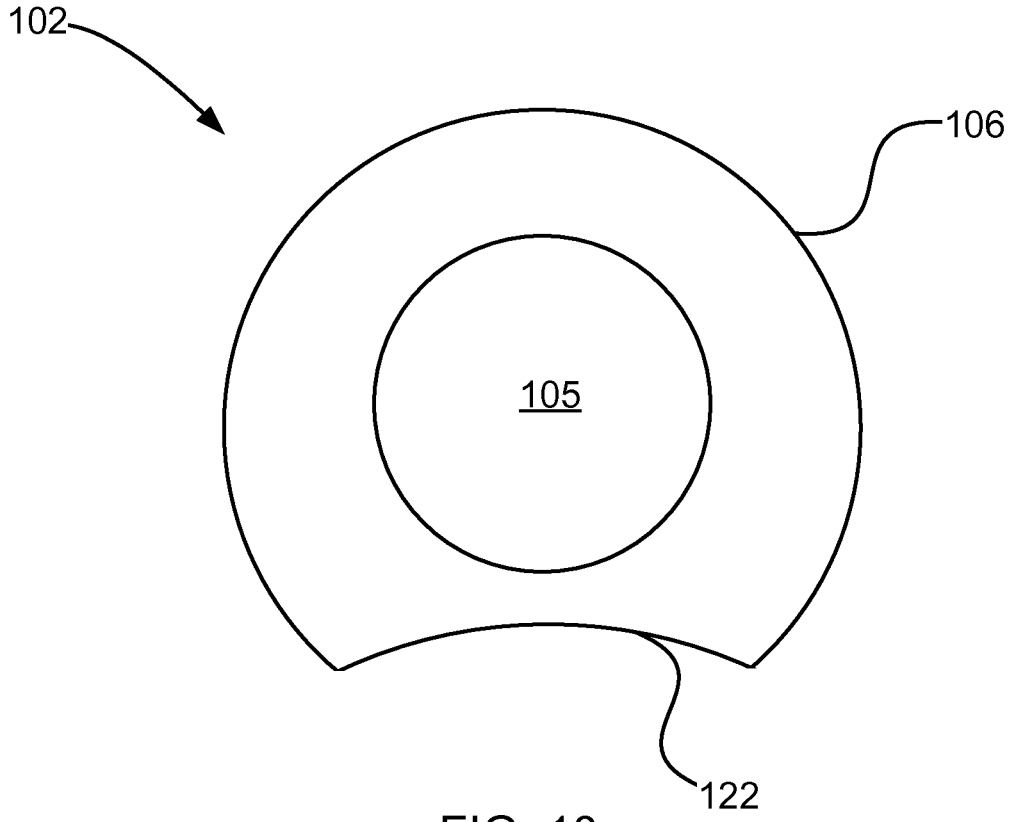
FIG. 10 is a cross sectional view of a pressure member having a length-wise concave segment according to one embodiment.
Figure 11:
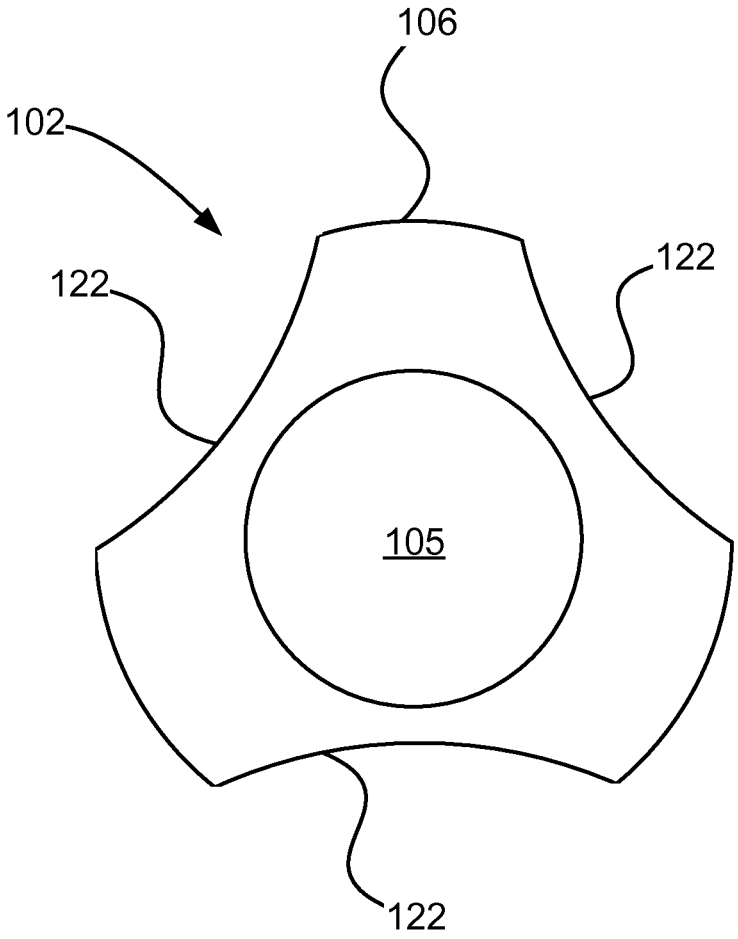
FIG. 11 is a cross sectional view of a pressure member having a plurality of length-wise concave segments according to one embodiment.

FIG. 10 illustrates an alternative embodiment that includes a pressure member 102 that includes an outer surface 106 having a length-wise concave segment 122. In the embodiment illustrated, the remainder of the pressure member 102 has a circular cross-section. The pressure member 102 is oriented such that the concave segment 122 applies pressure contact to the fusing belt 108 against the backup roll 112 to form a rounded fuser nip 114. Embodiments include those wherein the curvature of the concave segment 122 and curvature of the outer surface of the backup roll 112 are substantially the same such that the backup roll 112 is matably aligned with the concave segment 122. As shown in FIG. 11, in some embodiments, the outer surface 106 of the pressure member 102 includes at least one and in some cases a plurality of additional concave segments 122 that extend along the length of the outer surface 106. Where multiple concave segments 122 are employed, each segment 122 may have substantially the same width and radius of curvature, as illustrated in the embodiment shown. Alternatively, each segment 122 may have a different width and/or a different radius of curvature. The inclusion of multiple concave segments 122 allows selection of the segment 122 that will form the fuser nip 114.

Figure 12:
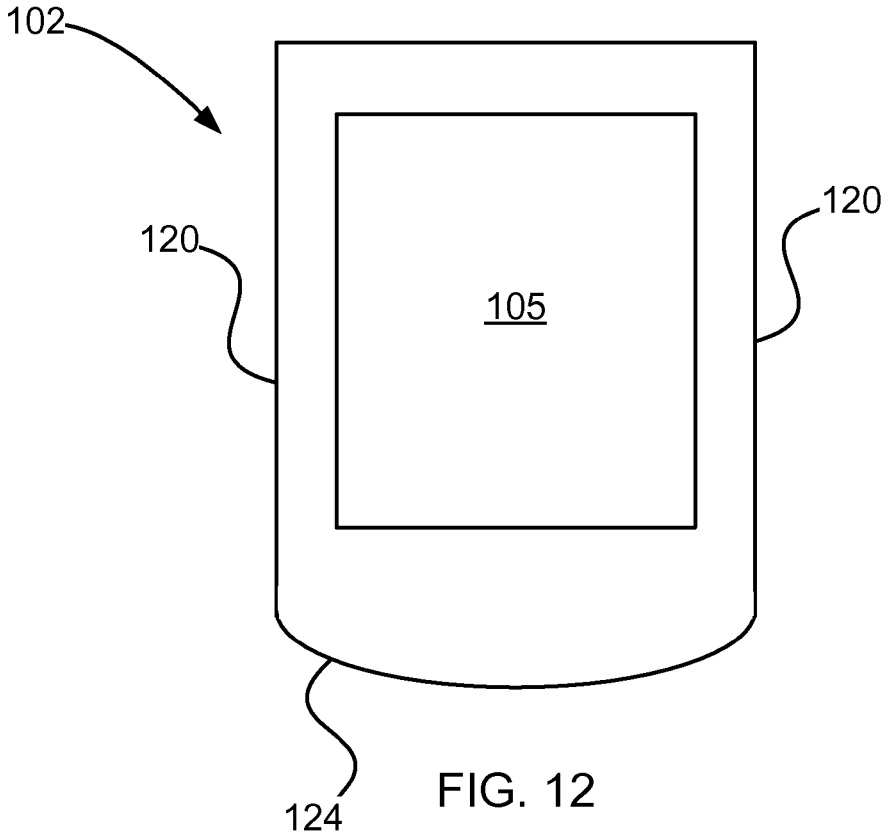
FIG. 12 is a cross sectional view of a pressure member having a length-wise convex segment according to one embodiment.
Figure 13:
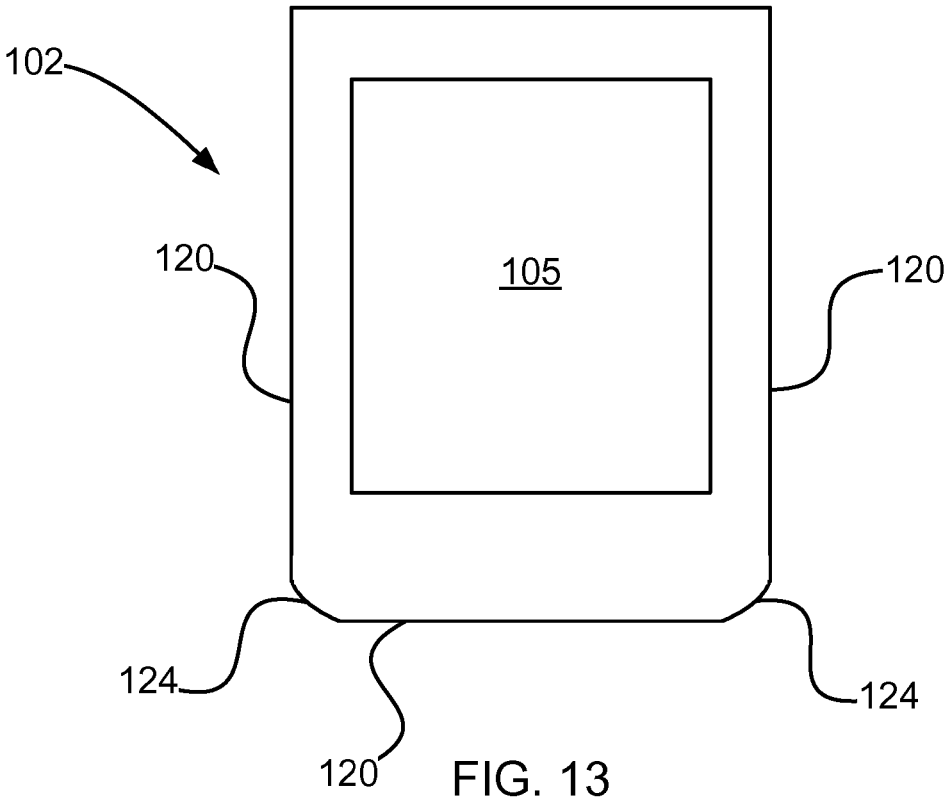
FIG. 13 is a cross sectional view of a pressure member having a pair of length-wise convex segments according to one embodiment.

Alternative embodiments include those wherein the outer surface 106 of the pressure member 102 includes a length-wise convex segment 124. In some embodiments, the outer surface 106 of the pressure member 102 has a substantially circular cross-section such that the entire outer surface 106 constitutes a length-wise convex segment 124. With reference to FIGS. 12 and 13, in some embodiments, the convex segment 124 is formed between two substantially planar length-wise segments 120. In some embodiments, the fuser nip 114 is formed along the convex segment 124. For example, the pressure member 102 illustrated in FIG. 12 includes a convex segment 124 formed between two substantially planar segments 120 wherein the convex segment 124 is configured to form the fuser nip 114. In other embodiments, the fuser nip 114 is formed along a surface other than the convex segment 124. For example, the pressure member 102 illustrated in FIG. 13 includes a pair of convex segments 124 formed between substantially planar segments 120 wherein the substantially planar segments 120 are configured to form the fuser nip 114.

Figure 14:
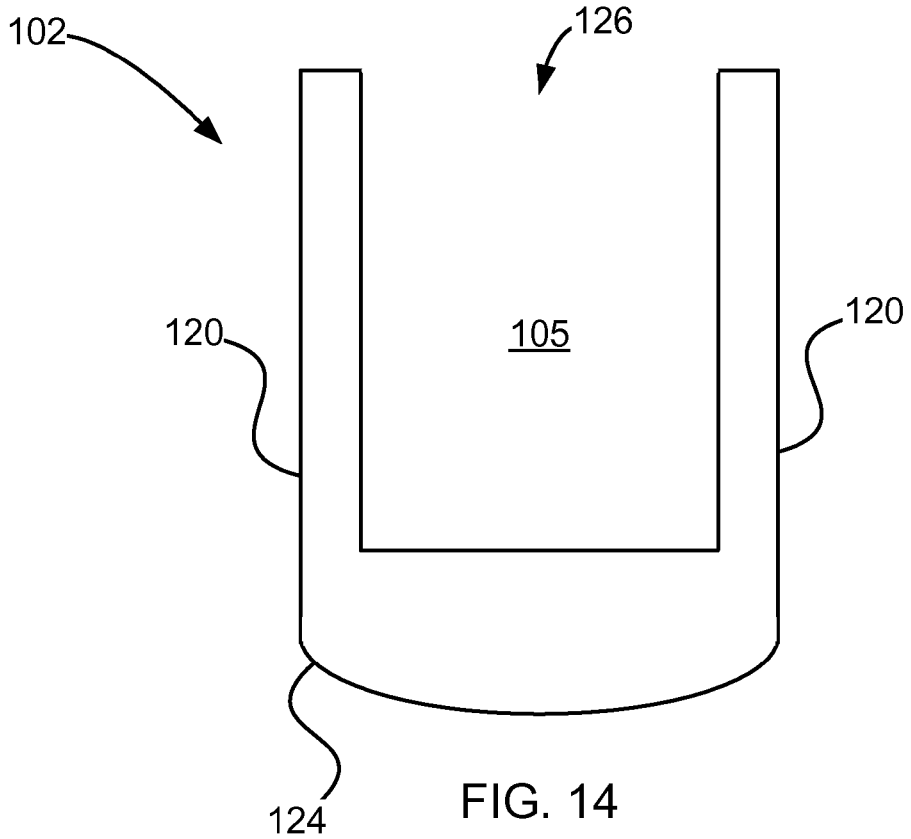
FIG. 14 is a cross sectional view of a pressure member having a length-wise cutout therein according to one embodiment.
Figure 15:
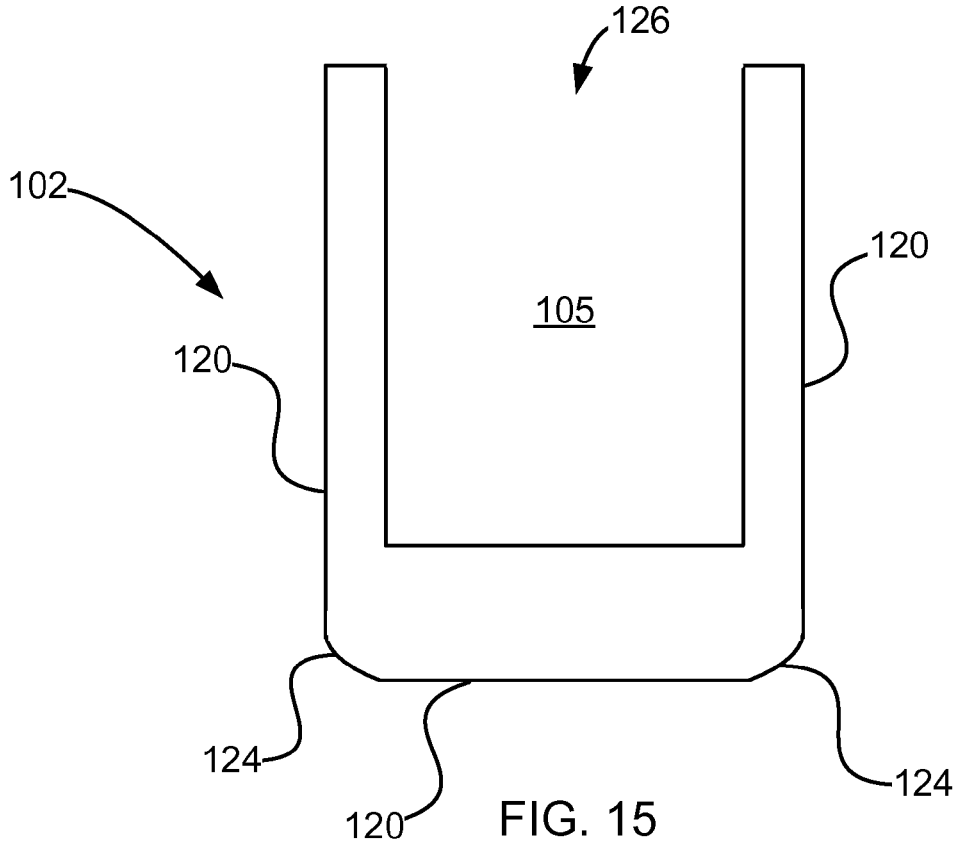
FIG. 15 is a cross sectional view of a pressure member having a length-wise cutout therein according to one embodiment.

With reference to FIGS. 14 and 15, embodiments include those wherein the outer surface 106 of the pressure member 102 includes at least one length-wise cutout 126 therein to permit the heating lamp 110 to transmit radiant heat directly to a portion of the inner surface 109 of the fusing belt 108 without passing through the pressure member 102. In these embodiments, the fusing belt 108 is positioned about the pressure member 102 such that a portion of the inner surface 109 of the fusing belt 108 is directly exposed to the heating lamp 110 spaced inwardly from the fusing belt 108. The outer surface 106 may further include a substantially planar surface 120, a concave surface 122 and/or a convex surface 124.

While FIGS. 8-15 illustrate a number of pressure members 102 having various suitable cross-sectional shapes, any combination of features including substantially planar segments 120, concave segments 122, convex segments 124 and cutouts 126 may be utilized as desired. For instance, the outer surface 106 of the pressure member 102 may include both a substantially planar length-wise segment 120 and a length-wise concave segment 122 and/or a length-wise convex segment 124 to allow for switching between a flat fuser nip 114 and a rounded fuser nip 114.

It will be appreciated that the stationary pressure member achieves a shorter warm up time than conventional stationary pressure members because substantially the entire inner surface of the fusing belt, as opposed to a segment thereof, is exposed to radiant heat during fusing operation. As a result, it is possible to achieve a higher fusing belt surface temperature without increasing the set point of the heater. This increased belt temperature permits faster fusing thus allowing faster print speeds. Further, the nip shape and size can be optimized to enhance print quality and belt life. For instance, a wider fuser nip than conventional lamp heating belt fusers can be selected to increase the pressure applied to the media and to permit faster print speeds. For example, testing has shown that the one embodiment of the fuser is able to fuse about 70 pages per minute while achieving the desired fuse grade and uniformity and that the temperature of the fusing belt can be maintained above 200° C. when a 230° C. set point is used.

The foregoing description of multiple embodiments has been presented for purposes of illustration. It is not intended to be exhaustive or to limit the application to the precise forms disclosed, and obviously many modifications and variations are possible in light of the above teaching. It is understood that the subject matter of the present application may be practiced in ways other than as specifically set forth herein without departing from the scope and essential characteristics. It is intended that the scope of the application be defined by the claims appended hereto.

What is claimed is:

1. A fuser for an electrophotographic imaging device, comprising:

a stationary pressure member having an elongated body that includes an outer surface, the pressure member being one of substantially transparent and substantially translucent and permits the passage of radiant heat therethrough;

an endless fusing belt having a flexible tubular configuration rotatably positioned about the pressure member;

a heating lamp for transmitting radiant heat through the pressure member to an inner surface of the fusing belt, the pressure member being positioned around the heating lamp; and a backup roll opposing the fusing belt, wherein the pressure member is configured to apply pressure contact to the fusing belt against the backup roll to form a fuser nip between the backup roll and a segment of the fusing belt;

wherein the outer surface of the pressure member includes a length-wise concave segment.

2. The fuser of claim 1, wherein the outer surface of the pressure member includes a substantially planar length-wise segment.

3. The fuser of claim 2, wherein the fuser nip is formed along the substantially planar segment.

4. The fuser of claim 2, wherein the outer surface of the pressure member includes a plurality of additional substantially planar length-wise segments.

5. The fuser of claim 1, wherein the fuser nip is formed along the length-wise concave segment, the concave segment contacting the endless fusing belt.

6. The fuser of claim 1, wherein the outer surface of the pressure member includes a plurality of additional length-wise concave segments.

7. The fuser of claim 1, wherein the backup roll is matably aligned with the concave segment.

8. A fuser for an electrophotographic imaging device, comprising:

a stationary pressure member having an elongated body that includes an outer surface, the pressure member being one of substantially transparent and substantially translucent and permits the passage of radiant heat therethrough;

an endless fusing belt having a flexible tubular configuration rotatably positioned about the pressure member;

a heating lamp for transmitting radiant heat through the pressure member to an inner surface of the fusing belt, the pressure member being positioned around the heating lamp; and a backup roll opposing the fusing belt, wherein the pressure member is configured to apply pressure contact to the fusing belt against the backup roll to form a fuser nip between the backup roll and a segment of the fusing belt;

wherein the elongated body of the pressure member includes a length-wise cutout therein to permit the heating lamp to transmit radiant heat directly to a portion of an inner surface of the fusing belt without passing through the pressure member.

9. The fuser of claim 8, wherein the outer surface of the pressure member includes a length-wise segment that is one of substantially planar and concave.

10. The fuser of claim 1, wherein the outer surface of the pressure member includes a length-wise convex segment formed between two concave length-wise segments.

11. The fuser of claim 1, wherein the pressure member is comprised of at least one of quartz and glass.

12. A fuser for an electrophotographic imaging device, comprising:

a stationary pressure member having an elongated rounded tubular body being one of substantially transparent and substantially translucent and permits the passage of radiant heat therethrough, an outer surface of the tubular body having a length-wise segment that is one of substantially planar and concave;

an endless fusing belt having a flexible tubular configuration rotatably positioned about the pressure member and spaced outwardly therefrom;

a heating lamp for transmitting radiant heat through the pressure member to an inner surface of the fusing belt, the pressure member being positioned around the heating lamp; and a backup roll opposing the fusing belt, wherein the pressure member is configured to apply pressure contact to the fusing belt against the backup roll along the length-wise segment of the pressure member to form a fuser nip between the backup roll and a segment of the fusing belt;

wherein the outer surface of the tubular body includes at least one additional length-wise segment that is one of substantially planar and concave, the at least one additional length-wise segment and the length-wise segment being spaced apart from each other.

13. The fuser of claim 12, wherein said length-wise segment and said at least one additional length-wise segment have substantially the same dimensions.

14. The fuser of claim 12, wherein the outer surface of the tubular body includes a length-wise convex segment.

15. The pressure member of claim 12, wherein the body is comprised of at least one of quartz and glass.

16. A pressure member for a fuser of an electrophotographic imaging device, comprising:

an elongated body that is at least one of substantially transparent and substantially translucent and permits the passage of radiant heat therethrough;

wherein an outer surface of the body has a non-circular cross-section and a plurality of length-wise segments selected from the group consisting of substantially planar and concave, each length-wise segment being spaced apart from each other along the outer surface of the elongated body.

17. The pressure member of claim 16, wherein the outer surface of the body includes a length-wise cutout therein.

18. The pressure member of claim 16, wherein the outer surface of the body includes a length-wise convex segment.

19. The pressure member of claim 16, wherein the body is comprised of at least one of quartz and glass.

20. The fuser of claim 1, wherein the length-wise concave segment of the outer surface of the pressure member contacts the endless fusing belt.

21. The fuser of claim 1, wherein the outer surface of the pressure member includes at least one additional length-wise concave segment, the at least one additional length-wise concave segment being spaced apart from the length-wise concave segment along the outer surface.

22. The fuser of claim 21, wherein each length-wise concave segment has a different radius of curvature relative to others of the length-wise concave segments, each length-wise concave segment being dimensioned for contacting the endless fusing belt at the fuser nip.

23. The pressure member of claim 16, wherein the plurality of length-wise segments comprise concave segments, each length-wise concave segment having a different radius of curvature relative to others of the length-wise concave segments.

24. The fuser of claim 12, wherein the length-wise segment and the at least one additional length-wise segment are substantially planar and have different widths.

25. A fuser for an electrophotographic imaging device, comprising:

a stationary pressure member having an elongated body that includes an outer surface, the pressure member being one of substantially transparent and substantially translucent and permits the passage of radiant heat therethrough;

an endless fusing belt having a flexible tubular configuration rotatably positioned about the pressure member;

a heating lamp for transmitting radiant heat through the pressure member to an inner surface of the fusing belt, the pressure member being positioned around the heating lamp; and a backup roll opposing the fusing belt, wherein the pressure member is configured to apply pressure contact to the fusing belt against the backup roll to form a fuser nip between the backup roll and a segment of the fusing belt;

wherein the outer surface of the pressure member includes a plurality of substantially planar length-wise segments.

26. A fuser for an electrophotographic imaging device, comprising:

a stationary pressure member having an elongated body that includes an outer surface, the pressure member being one of substantially transparent and substantially translucent and permits the passage of radiant heat therethrough;

an endless fusing belt having a flexible tubular configuration rotatably positioned about the pressure member;

a heating lamp for transmitting radiant heat through the pressure member to an inner surface of the fusing belt, the pressure member being positioned around the heating lamp; and a backup roll opposing the fusing belt, wherein the pressure member is configured to apply pressure contact to the fusing belt against the backup roll to form a fuser nip between the backup roll and a segment of the fusing belt;

wherein the outer surface of the pressure member includes a length-wise convex segment formed between two substantially planar length-wise segments.

* * * * *